US011045025B2

(12) United States Patent
Tseng

(10) Patent No.: US 11,045,025 B2
(45) Date of Patent: Jun. 29, 2021

(54) CUP HAVING INTEGRATED STRAW

(71) Applicant: Yung-Teng Tseng, Taitung County (TW)

(72) Inventor: Yung-Teng Tseng, Taitung County (TW)

(73) Assignee: Taiwan Smart Light Technology Co., Ltd., Taitung (TW)

( * ) Notice: Subject to any disclaimer, the term of this patent is extended or adjusted under 35 U.S.C. 154(b) by 18 days.

(21) Appl. No.: 16/731,088

(22) Filed: Dec. 31, 2019

(65) Prior Publication Data

US 2020/0128982 A1 Apr. 30, 2020

(30) Foreign Application Priority Data

Jul. 26, 2019 (TW) ..... 108209757

(51) Int. Cl.
*A47G 19/22* (2006.01)
*A47G 21/18* (2006.01)
*B65D 47/06* (2006.01)

(52) U.S. Cl.
CPC ..... *A47G 19/2272* (2013.01); *A47G 21/18* (2013.01); *B65D 47/06* (2013.01)

(58) Field of Classification Search
CPC ..... A47G 19/2272; A47G 19/2266; A47G 19/2205; A47G 19/2222; A47G 21/185; A47G 21/18; B65D 47/06; B65D 47/04
USPC ..... 220/710, 705, 676; 215/389, 388, 229
See application file for complete search history.

(56) References Cited

U.S. PATENT DOCUMENTS 2,779,515 A * 1/1957 Welty ..... B65D 39/12 222/394
4,437,576 A * 3/1984 Barniak ..... B65D 47/286 220/710
4,811,860 A * 3/1989 Sorenson ..... B65D 43/0212 206/508
2012/0061409 A1* 3/2012 Fioritto ..... B65D 77/286 220/708

* cited by examiner

*Primary Examiner* — Robert J Hicks

(57) ABSTRACT

A cup having an integrated straw is provided. The cup has a mold release surface at a liquid outlet portion, in the injection molding process, a male mold of an accommodating room can be directly removed from the mold release surface to form the liquid outlet portion. A cup body is integrally formed with a straw body, which can easily achieve injection molding release. When the cup body is filled with a solid or liquid beverage, the user can suck the beverage through a top opening portion of the straw body.

8 Claims, 6 Drawing Sheets

CUP HAVING INTEGRATED STRAW

FIELD OF THE INVENTION

The present invention relates to a cup, and more particularly to a cup having an integrated straw. The cup has a straw body integrally formed with a cup body for sucking the beverage inside the cup body, and has a mold release surface that facilitates demolding. The cup is an innovative structural with convenience, environmentally sustainable development, and commercial application.

BACKGROUND OF THE INVENTION

In general, a cup has an internal accommodating space for containing beverages (including solid and liquid food) or liquids such as water. When drinking, the user makes the mouth touch the edge of the cup for drinking beverages. When the user is driving or working, the user needs to raise his/her head for taking a drink of beverages, so that the line of sight is directed upward, which will increase the danger of driving or working and may cause a car accident or work injury.

A conventional environmentally-friendly cup integrated with a straw, as disclosed in Taiwan Utility Model Publication No. M571699, can improve environmental protection, instead of using straws in conventional cups. However, in the manufacturing process, if the plastic injection molding is changed, it is difficult to demold. Therefore, the straw is attached to the inner wall surface of the cup through a secondary processing, which makes the manufacturing process relatively complicated. The secondary processing consumes more time and the production cost is higher, so the economic benefit of the overall cup structure is low.

Most supermarkets or beverage sellers use plastic sealing film to close a cup mouth for selling cold beverages, and then the user pierces the plastic sealing film using a straw, so that the straw can extend into the beverage cup for sucking cold beverages. On the other hand, supermarkets or beverage sellers sell hot beverages contained in cups. By tilting the cup, the hot beverage inside the cup flows out through the opening of the lid, and the user drinks the hot beverage through the opening. However, the above cold beverage cup and hot beverage cup have different usage methods. If supermarkets or beverage sellers can use a single cup lid for the cup body to achieve a structure that can serve both cold and hot beverages, it can increase the commonality or versatility of beverage cups.

Accordingly, the inventor of the present invention has devoted himself based on his many years of practical experiences to solve these problems.

SUMMARY OF THE INVENTION

The primary object of the present invention is to provide a cup having an integrated straw. The cup comprises a cup body and an upper lid. The cup body has a cup wall, a cup bottom, and an accommodating room surrounded by the cup wall and the cup bottom. A center of the accommodating room defines a central axis.

An outer wall surface of the cup wall is integrally formed with an inclined straw body. An upper end of the straw body is formed with a top opening portion for sucking. Another end of the top opening portion extends to an inner bottom of the accommodating room and forms a liquid outlet portion for attracting a liquid. The liquid outlet portion is formed with a mold release surface parallel to the central axis of the accommodating room.

An engaging portion corresponding to a top edge of the cup body is formed around a bottom edge of the upper lid for covering an open end of the cup body. A hot drink opening is formed on one side of a top surface of the upper lid.

With the above structure, the cup body is integrally formed with the straw body, which can easily achieve injection molding release. When the accommodating room of the cup body is filled with a low temperature or normal temperature beverage, the user can suck the low temperature or normal temperature beverage from the liquid outlet portion through the top opening portion of the straw body. When the accommodating room of the cup body is filled with a high-temperature beverage, the user can directly drink high-temperature beverage through the hot beverage opening. The cup can be used for cold or hot beverages, having commonality and universality to enhance the benefits of convenient drinking.

Preferably, the straw body is connected to the outer wall surface of the cup wall through a rib portion, so that the straw body can be firmly connected to the outer wall surface of the cup wall to increase the structural strength of the straw body.

Preferably, an angle θ is defined between the cup bottom of the cup body and the mold release surface, and the angle θ is 75 degrees to 89 degrees. When the accommodating room is filled with pearl milk tea or soft food, the pearl milk tea or soft food can slide down to the position of the liquid outlet portion through the inclination of the cup bottom to facilitate suction.

Preferably, the top opening portion is provided with a plug to prevent foreign matter from entering the top opening portion, so as to reduce the pollution of the food.

Preferably, the upper lid is formed with a straw body connecting portion extending outward. The straw body connecting portion has a straw body connecting hole correspondingly connected to the top opening portion. The upper lid is formed with a top lid nozzle extending upward from a top of the straw body connection hole. The upper lid nozzle is configured to directly suck the beverage in the cup body for drinking conveniently.

Preferably, the hot drink opening of the upper lid is provided with a hot drink opening sealing sticker that can be torn. The top lid has an opening for adding coffee mate or sugar. The opening is provided with an opening sealing sticker that can be torn, which can prevent foreign matter from entering the accommodating room, thereby reducing the pollution of the food.

Embodiments of the present invention will now be described, by way of example only, with reference to the accompanying drawings.

DETAILED DESCRIPTION OF THE PREFERRED EMBODIMENTS

Figure 1:
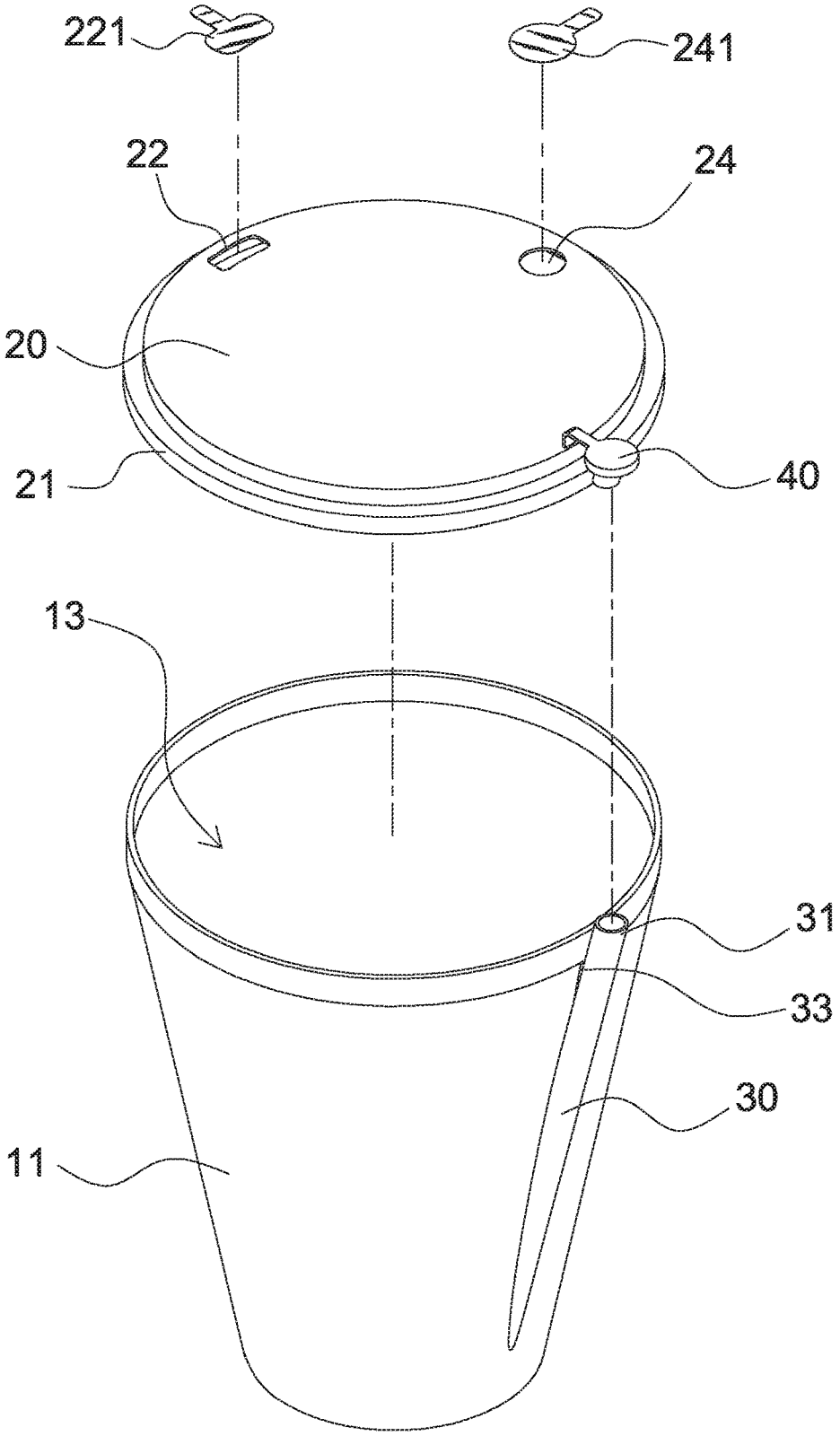
FIG. 1 is an exploded view according to a first embodiment of the present invention.
Figure 2:
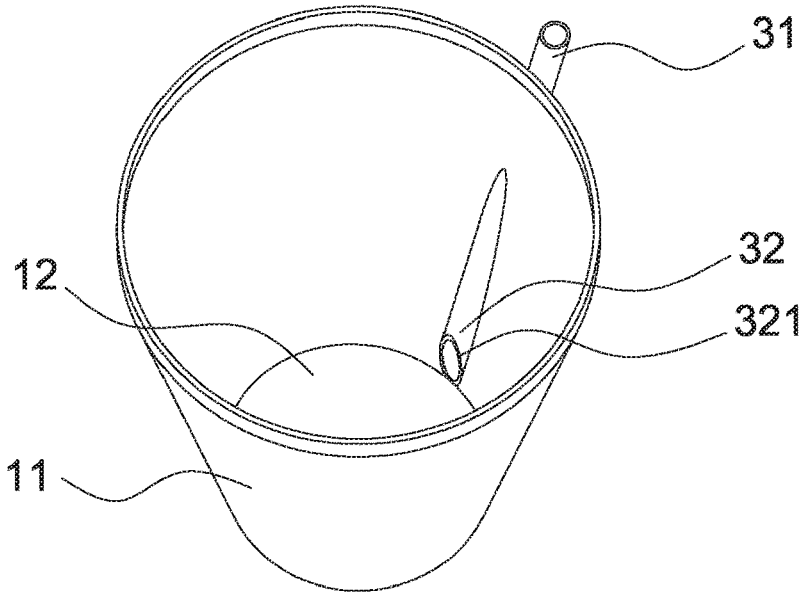
FIG. 2 is a perspective view showing the liquid outlet portion of the cup body of the present invention.
Figure 3:
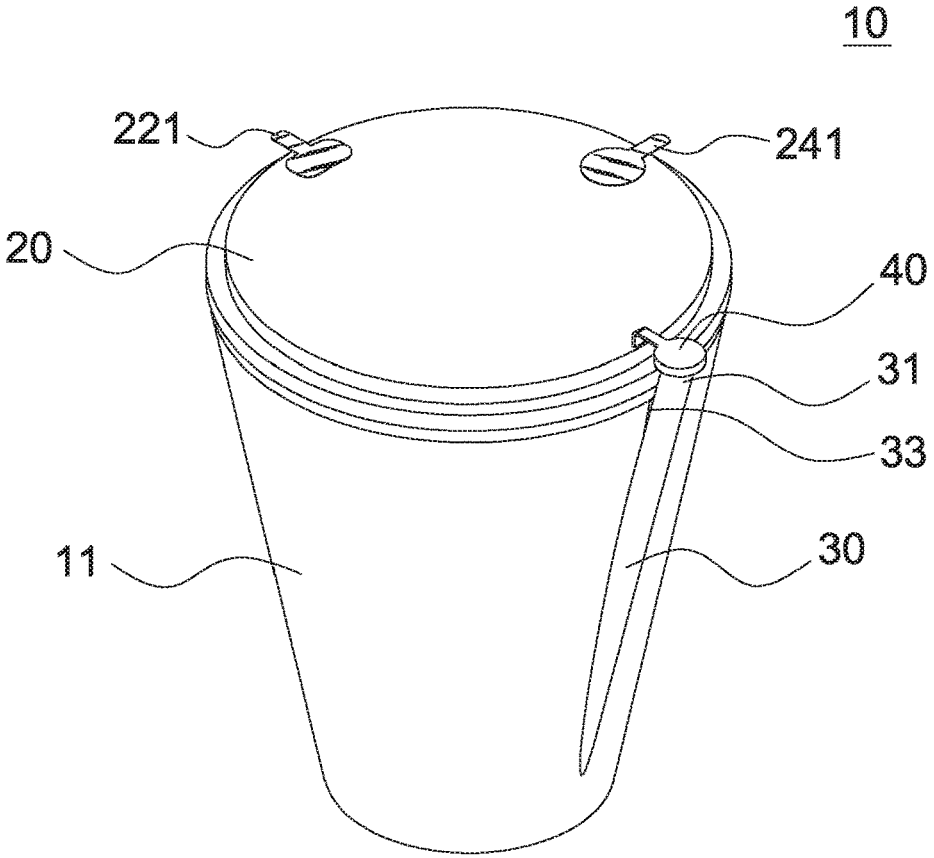
FIG. 3 is a perspective view according to the first embodiment of the present invention.

Referring to FIG. 1 to FIG. 5, the present invention discloses a cup having an integrated straw. The cup comprises a cup body 10 and an upper lid 20. The cup body 10 has a cup wall 11, a cup bottom 12, and an accommodating room 13 surrounded by the cup wall 11 and the cup bottom 12. The center of the accommodating room 13 defines a central axis 131.

The outer wall surface of the cup wall 11 is integrally formed with an inclined straw body 30. The upper end of the straw body 30 is formed with a top opening portion 31 for sucking. The other end of the top opening portion 31 extends to the inner bottom of the accommodating room 13 and forms a liquid outlet portion 32 for attracting a liquid. The liquid outlet portion 32 is formed with a mold release surface 321 parallel to the central axis 131 of the accommodating room 13.

An engaging portion 21 corresponding to the top edge of the cup body 10 is formed around the bottom edge of the upper lid 20 for covering an open end of the cup body 10. A hot drink opening 22 is formed on one side of the top surface of the upper lid 20 for the user to drink the hot drink in the accommodating room 13.

The straw body 30 is connected to the outer wall surface of the cup wall 11 through a rib portion 33, so that the straw body 30 can be firmly connected to the outer wall surface of the cup wall 11 to increase the structural strength of the straw body 30.

Figure 4:
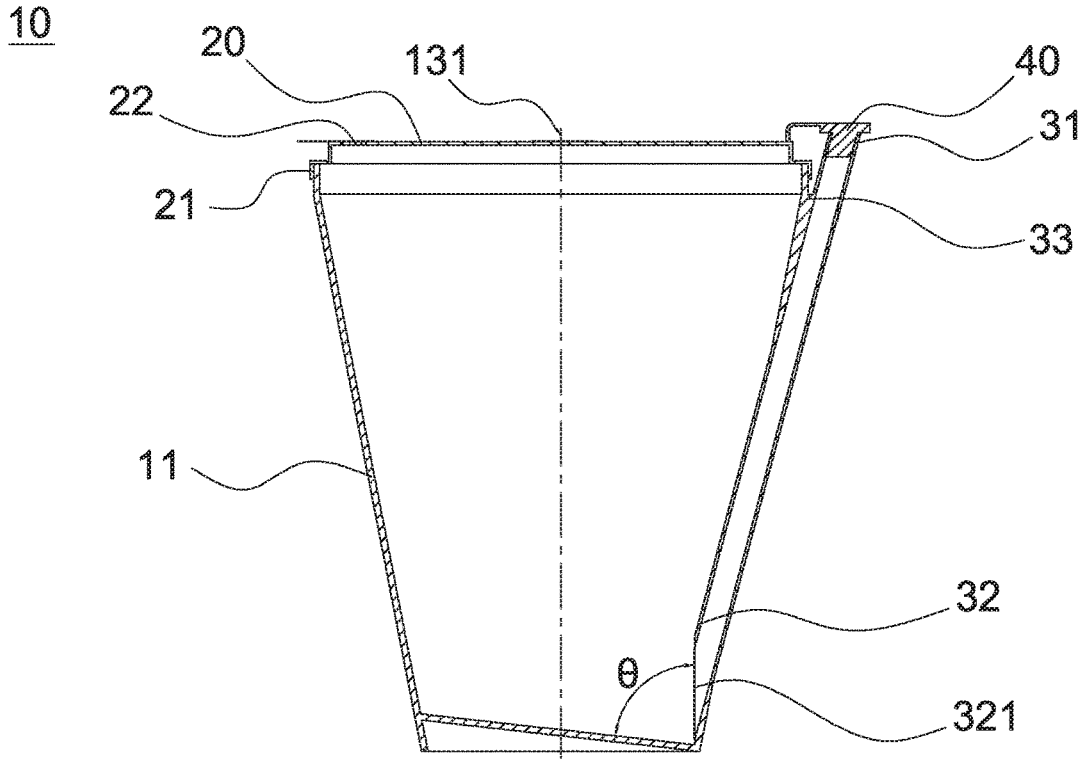
FIG. 4 is a cross-sectional view according to the first embodiment of the present invention.
Figure 5:
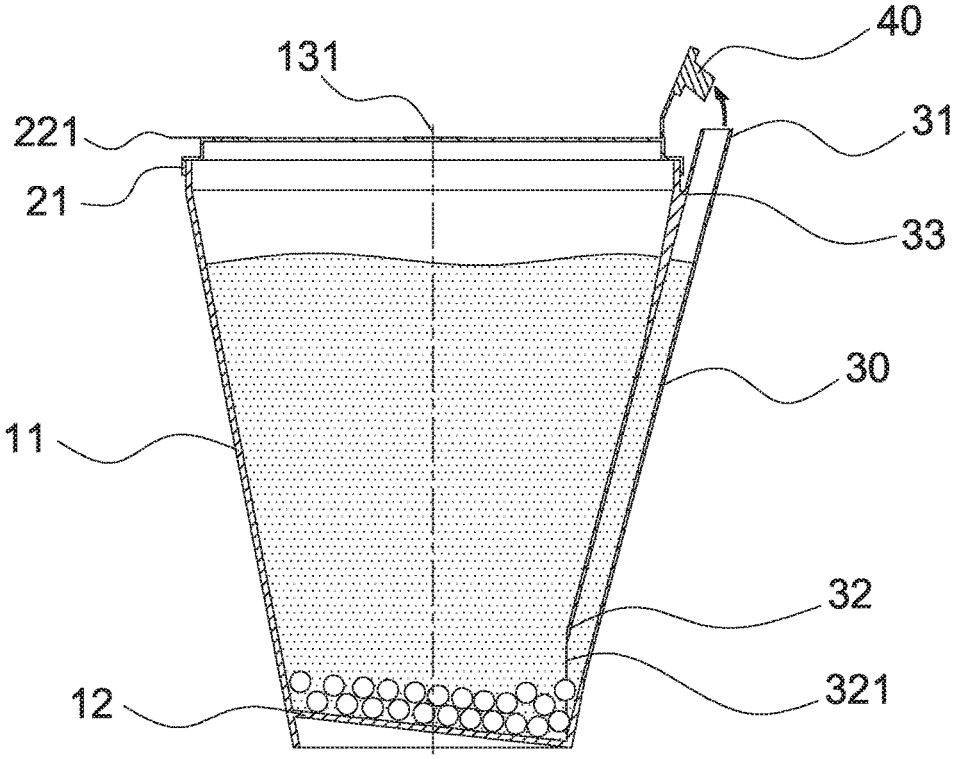
FIG. 5 is a cross-sectional view according to the first embodiment of the present invention when in use.
Figure 9:
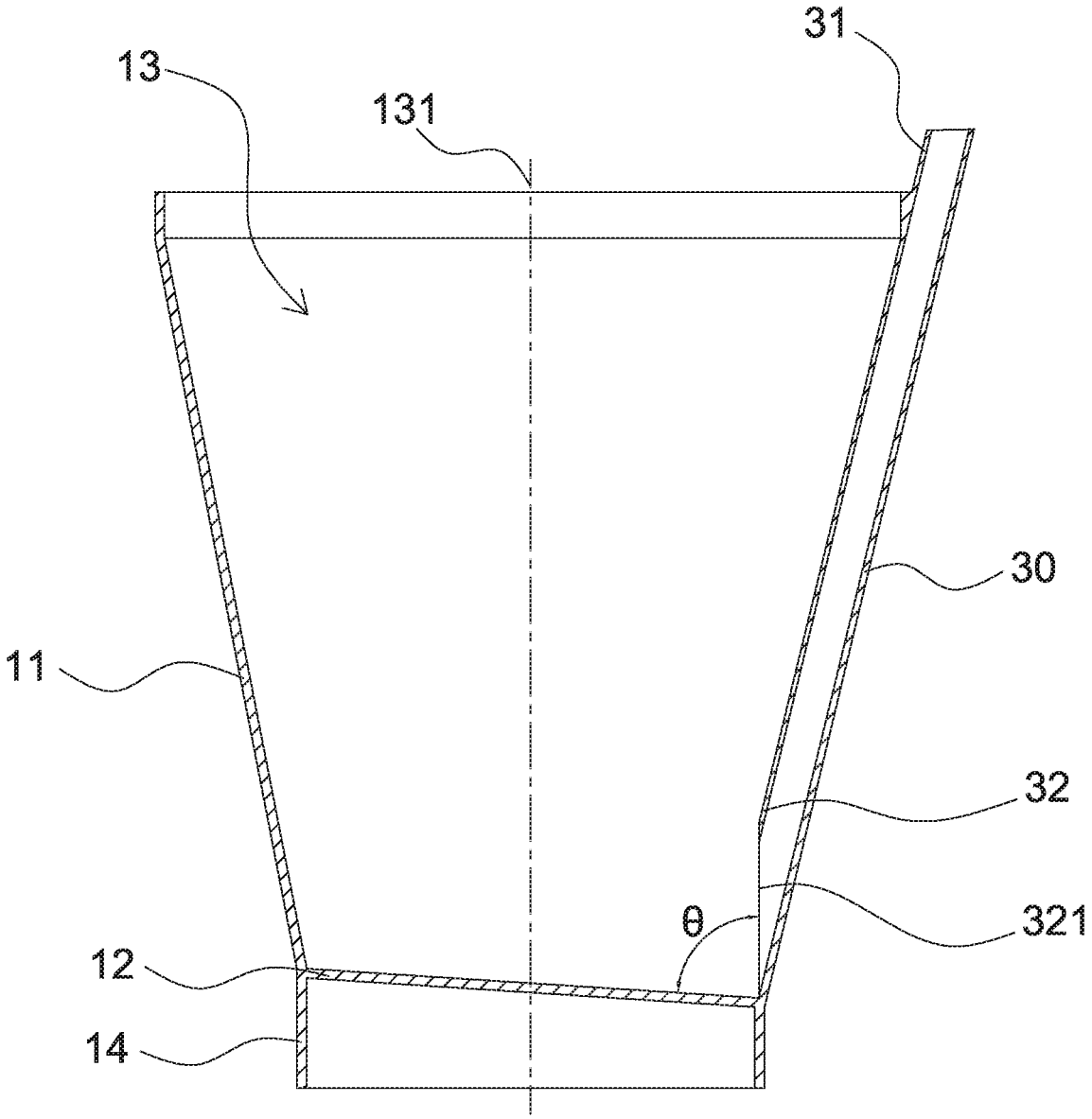
FIG. 9 is a cross-sectional view showing the cup bottom holding portion extending from the bottom of the cup of the present invention.

Referring to FIG. 4, FIG. 5 and FIG. 9, an angle θ is defined between the cup bottom 12 of the cup body 10 and the mold release surface 321. The angle θ is 75 degrees to 89 degrees. When the accommodating room 13 is filled with pearl milk tea or soft food, the pearl milk tea or soft food can slide down to the position of the liquid outlet portion 32 through the inclination of the cup bottom 12 to facilitate suction.

Preferably, referring to FIG. 1, FIG. 3, FIG. 4 and FIG. 5, the top opening portion 31 is provided with a plug 40 to prevent foreign matter from entering the top opening portion 31, so as to reduce the pollution of the accommodating room 13.

Figure 6:
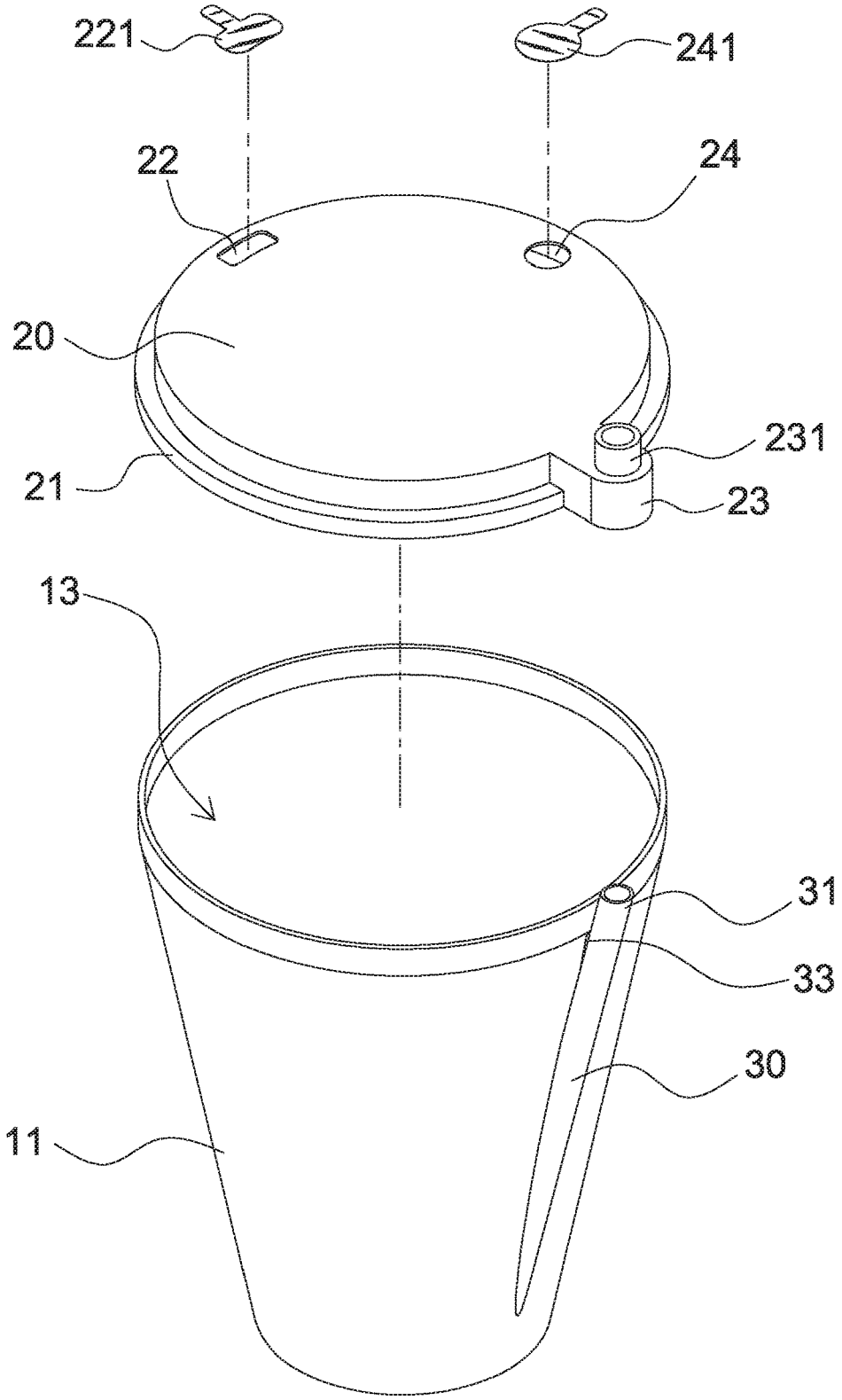
FIG. 6 is an exploded view according to a second embodiment of the present invention.
Figure 7:
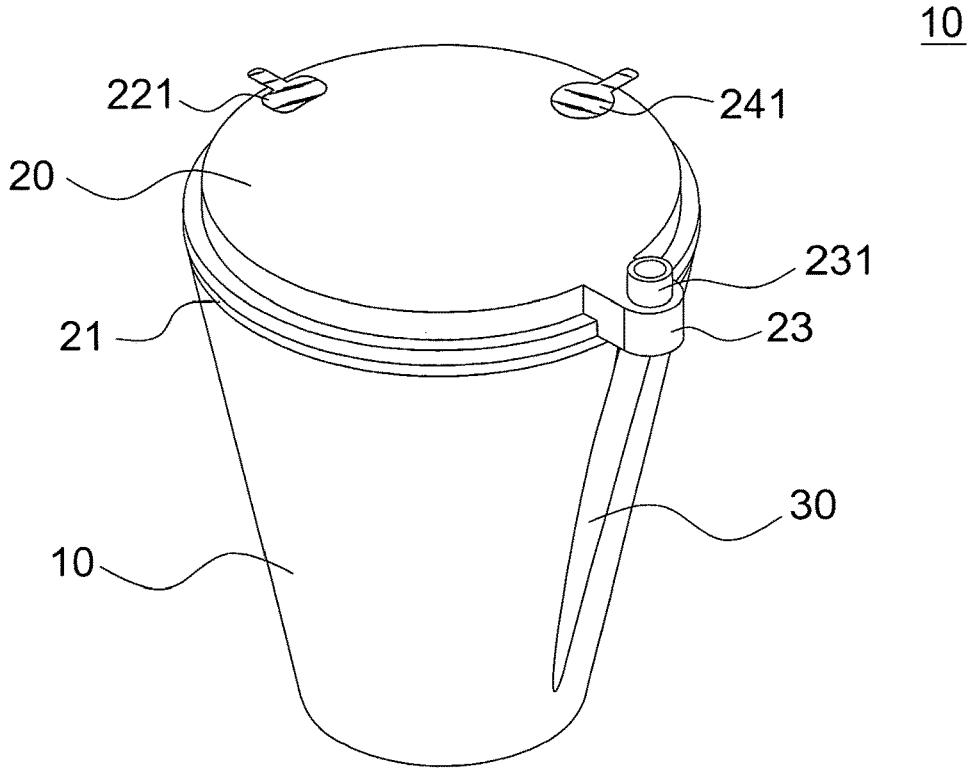
FIG. 7 is a perspective view according to a second embodiment of the present invention.
Figure 8:
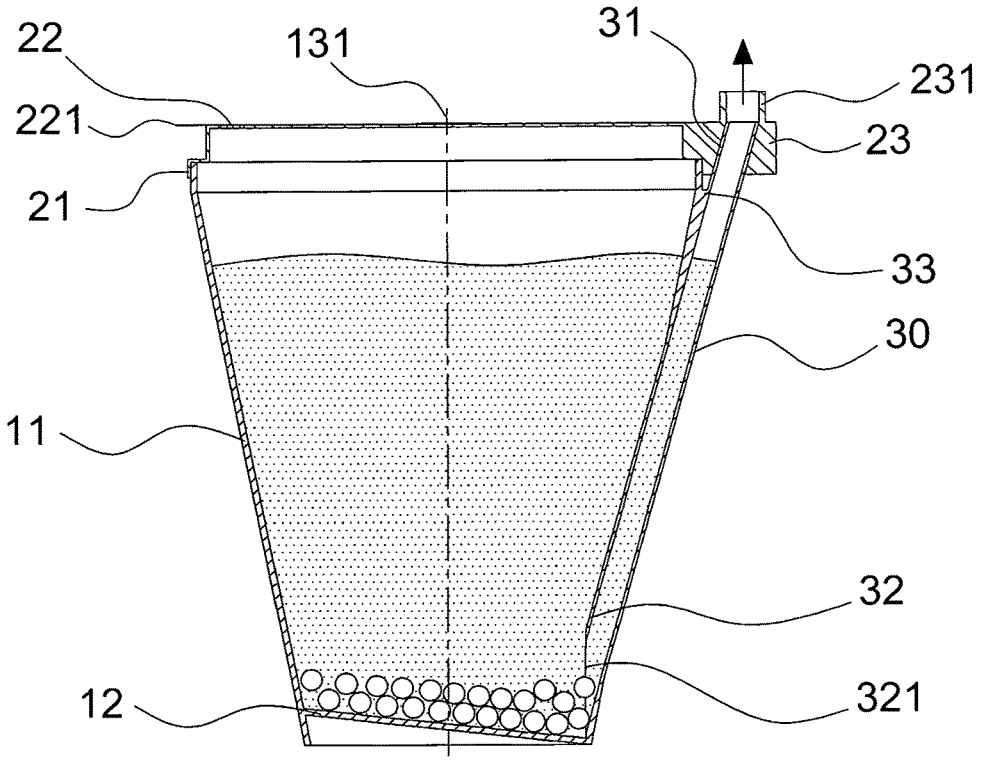
FIG. 8 is a cross-sectional view according to the second embodiment of the present invention when in use.

Furthermore, FIG. 6, FIG. 7 and FIG. 8 illustrate a second embodiment of the present invention. The upper lid 20 is formed with a straw body connecting portion 23 extending outward. The straw body connecting portion 23 has a straw body connecting hole 231 correspondingly connected to the top opening portion 31. The upper lid 20 is formed with a top lid nozzle 232 extending upward from the top of the straw body connection hole 231. The upper lid nozzle 232 is configured to directly suck the beverage in the cup body 10 for drinking conveniently.

Referring to FIG. 1, FIG. 3, FIG. 6 and FIG. 7, the hot drink opening 22 of the upper lid 20 is provided with a hot drink opening sealing sticker 221 that can be torn. The top lid 20 has an opening 24 for adding Coffee mate® or sugar. The opening 24 is provided with an opening sealing sticker 241 to prevent foreign matter from entering the accommodating room 13, thereby reducing the pollution of the food.

Finally, referring to FIG. 8, the bottom edge of the cup bottom 12 of the cup body 10 extends downward to form a cup bottom holding portion 14 for the user's hand to hold thereon.

In detail, because the mold release surface 321 of the liquid outlet portion 32 of the straw body 30 is parallel to the central axis 131 of the accommodating room 13, in the injection molding process, the male mold of the accommodating room 13 can be directly removed from the mold release surface 321 to form the liquid outlet portion 32. The cup body 10 is integrally formed with the straw body 30, which can easily achieve injection molding release. When the accommodating room 13 of the cup body 10 is filled with a low temperature or normal temperature beverage (including solid food or liquid food, such as Konnyaku Jelly, fruit, smoothie, etc.), the user can suck the low temperature or normal temperature beverage from the liquid outlet portion 32 through the top opening portion 31 of the straw body 30. When the accommodating room 13 of the cup body 10 is filled with a high-temperature beverage, the user can directly drink a high-temperature beverage through the hot beverage opening 22. The cup can be used for cold or hot beverages, having commonality and universality to enhance the benefits of convenient drinking. Therefore, the present invention is an innovative structure with convenience, environmentally sustainable development, and commercial application.

Although particular embodiments of the present invention have been described in detail for purposes of illustration, various modifications and enhancements may be made without departing from the spirit and scope of the present invention. Accordingly, the present invention is not to be limited except as by the appended claims.

What is claimed is:

1. A cup having an integrated straw, comprising a cup body and an upper lid, the cup body having a cup wall, a cup bottom and an accommodating room surrounded by the cup wall and the cup bottom, a center of the accommodating room defining a central axis;

an outer wall surface of the cup wall being integrally formed with an inclined straw body, an upper end of the straw body being formed with a top opening portion for sucking, another end of the top opening portion extending to an inner bottom of the accommodating room and forming a liquid outlet portion for attracting a liquid, the liquid outlet portion being formed with a mold release surface parallel to the central axis of the accommodating room;

an engaging portion corresponding to a top edge of the cup body being formed around a bottom edge of the upper lid for covering an open end of the cup body, a hot drink opening being formed on one side of a top surface of the upper lid.

2. The cup having an integrated straw as claimed in claim 1, wherein the straw body is connected to the outer wall surface of the cup wall through a rib portion.

3. The cup having an integrated straw as claimed in claim 1, wherein an angle (θ) is defined between the cup bottom of the cup body and the mold release surface, and the angle (θ) is 75 degrees to 89 degrees.

4. The cup having an integrated straw as claimed in claim 1, wherein the top opening portion is provided with a plug.

5. The cup having an integrated straw as claimed in claim 1, wherein the upper lid is formed with a straw body connecting portion extending outward, the straw body connecting portion has a straw body connecting hole correspondingly connected to the top opening portion, and the upper lid is formed with a top lid nozzle extending upward from a top of the straw body connection hole.

6. The cup having an integrated straw as claimed in claim 1, wherein the hot drink opening of the upper lid is provided with a hot drink opening sealing sticker that can be torn.

7. The cup having an integrated straw as claimed in claim 1, wherein the top lid has an opening for adding Coffee mate® or sugar.

8. The cup having an integrated straw as claimed in claim 7, wherein the opening is provided with an opening sealing sticker that can be torn.

* * * * *